US008636046B2

(12) United States Patent
Ballarotti

(10) Patent No.: US 8,636,046 B2
(45) Date of Patent: Jan. 28, 2014

(54) LABELING MACHINE

(75) Inventor: Mario Ballarotti, Marmirolo (IT)

(73) Assignee: P.E. Labellers S.p.A. (IT)

( * ) Notice: Subject to any disclaimer, the term of this patent is extended or adjusted under 35 U.S.C. 154(b) by 0 days.

(21) Appl. No.: 12/450,157

(22) PCT Filed: Mar. 18, 2008

(86) PCT No.: PCT/EP2008/053196
§ 371 (c)(1),
(2), (4) Date: Sep. 14, 2009

(87) PCT Pub. No.: WO2008/119658
PCT Pub. Date: Oct. 9, 2008

(65) Prior Publication Data

US 2010/0096091 A1 Apr. 22, 2010

(30) Foreign Application Priority Data

Mar. 30, 2007 (IT) ..... MN2007A0010

(51) Int. Cl.
*G05G 15/00* (2006.01)

(52) U.S. Cl.
USPC ..... 156/350; 156/64; 156/351; 156/353; 156/354; 156/361; 156/362; 156/363; 156/364; 156/365; 156/366; 156/367; 156/378; 156/379

(58) Field of Classification Search
USPC ..... 156/64, 350, 351, 353, 354, 361, 362, 156/363, 364, 365, 366, 367, 378, 379
See application file for complete search history.

(56) References Cited

U.S. PATENT DOCUMENTS

| | | | | |
|---|---|---|---|---|
| RE28,732 | E * | 3/1976 | von Hofe | 156/64 |
| 4,253,902 | A * | 3/1981 | Yada | 156/361 |
| 2005/0115680 | A1 * | 6/2005 | Thoms et al. | 156/354 |

FOREIGN PATENT DOCUMENTS

| | | |
|---|---|---|
| EP | 0 414 056 A | 2/1991 |

* cited by examiner

*Primary Examiner* — Katarzyna Wyrozebski Lee
*Assistant Examiner* — Joshel Rivera
(74) *Attorney, Agent, or Firm* — Cantor Colburn LLP

(57) ABSTRACT

A labeling machine, comprising a conveyor of containers, each to be labeled with a label taken by cutting from a continuous ribbon wound in a reel, and further comprising feeder elements which are adapted to convey with the appropriate timing the ribbon to a device for the intermittent cutting of each individual label, and elements for locking the label during cutting which are inserted between the cutting device and a drum for transferring the cut label to a container provided on the conveyor.

3 Claims, 2 Drawing Sheets

LABELING MACHINE

The present invention relates to a labeling machine.

BACKGROUND OF THE INVENTION

Labeling machines are known which are designed to apply to containers of various kinds labels taken, by means of a cutting operation, from a continuous ribbon wound in a reel and work according to an operating principle which provides for continuous motion of the ribbon.

These machines have a considerable constructive complexity and a high cost, and therefore the aim of the present invention is to provide a labeling machine which is capable of working on labels in ribbon form without adhesive, i.e., pre-pasted in any manner, and which has great constructive simplicity.

SUMMARY OF THE INVENTION

This aim is achieved by a labeling machine according to the invention, comprising a conveyor of containers, each to be labeled with a label taken by cutting from a continuous ribbon wound in a reel, characterized in that it comprises feeder means which are adapted to convey with the appropriate timing the ribbon to a device for the intermittent cutting of each individual label, and means for locking the label during cutting which are inserted between said cutting device and a drum for transferring the cut label to a container provided on the conveyor.

BRIEF DESCRIPTION OF THE DRAWINGS

Further characteristics and advantages of the present invention will become better apparent from the description of a preferred but not exclusive embodiment thereof, illustrated by way of non-limiting example in the accompanying drawings, wherein.

DESCRIPTION OF THE PREFERRED EMBODIMENTS

Figure 1:
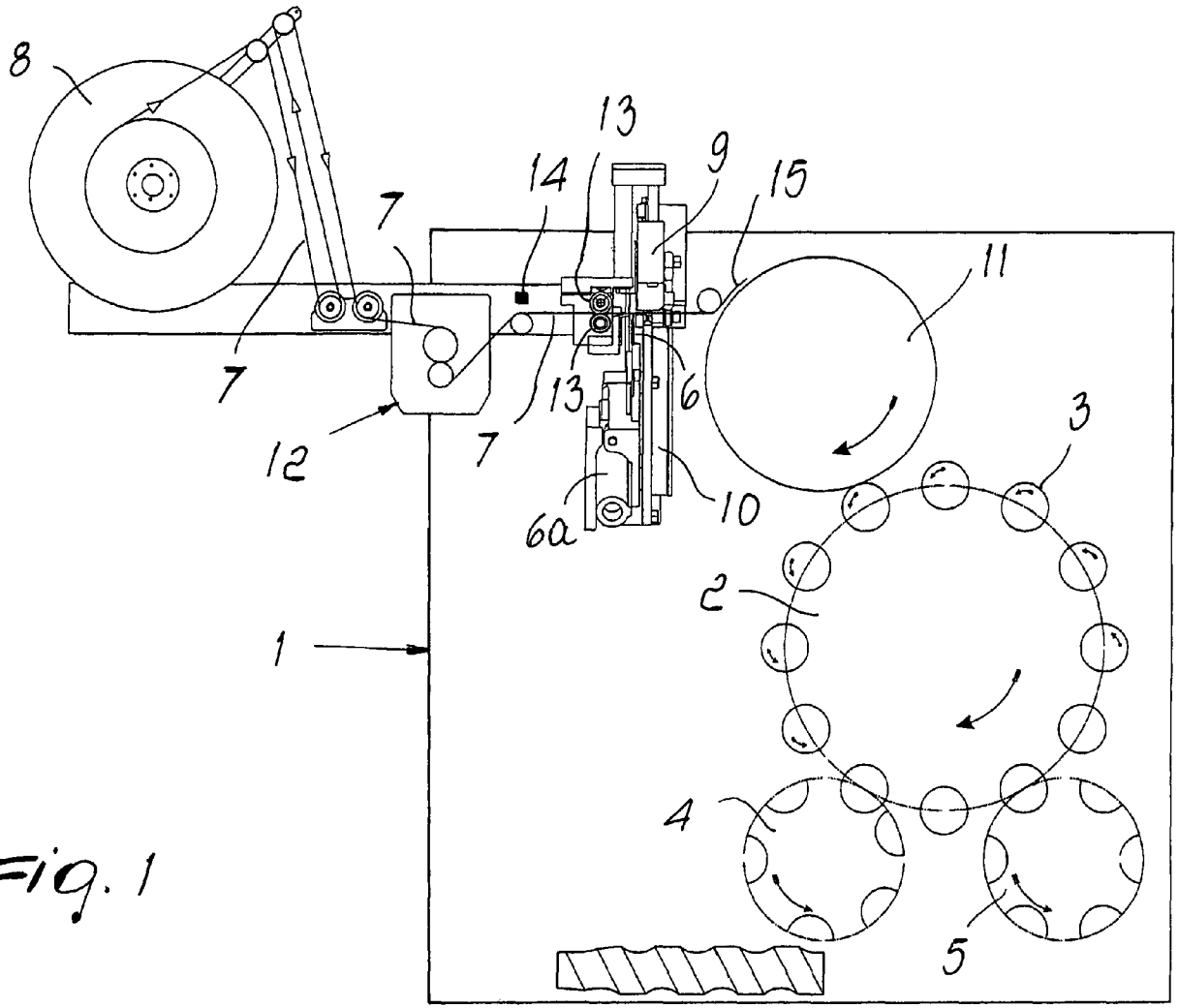
FIG. 1 is a schematic plan view of the labeling machine according to the invention.
Figure 2:
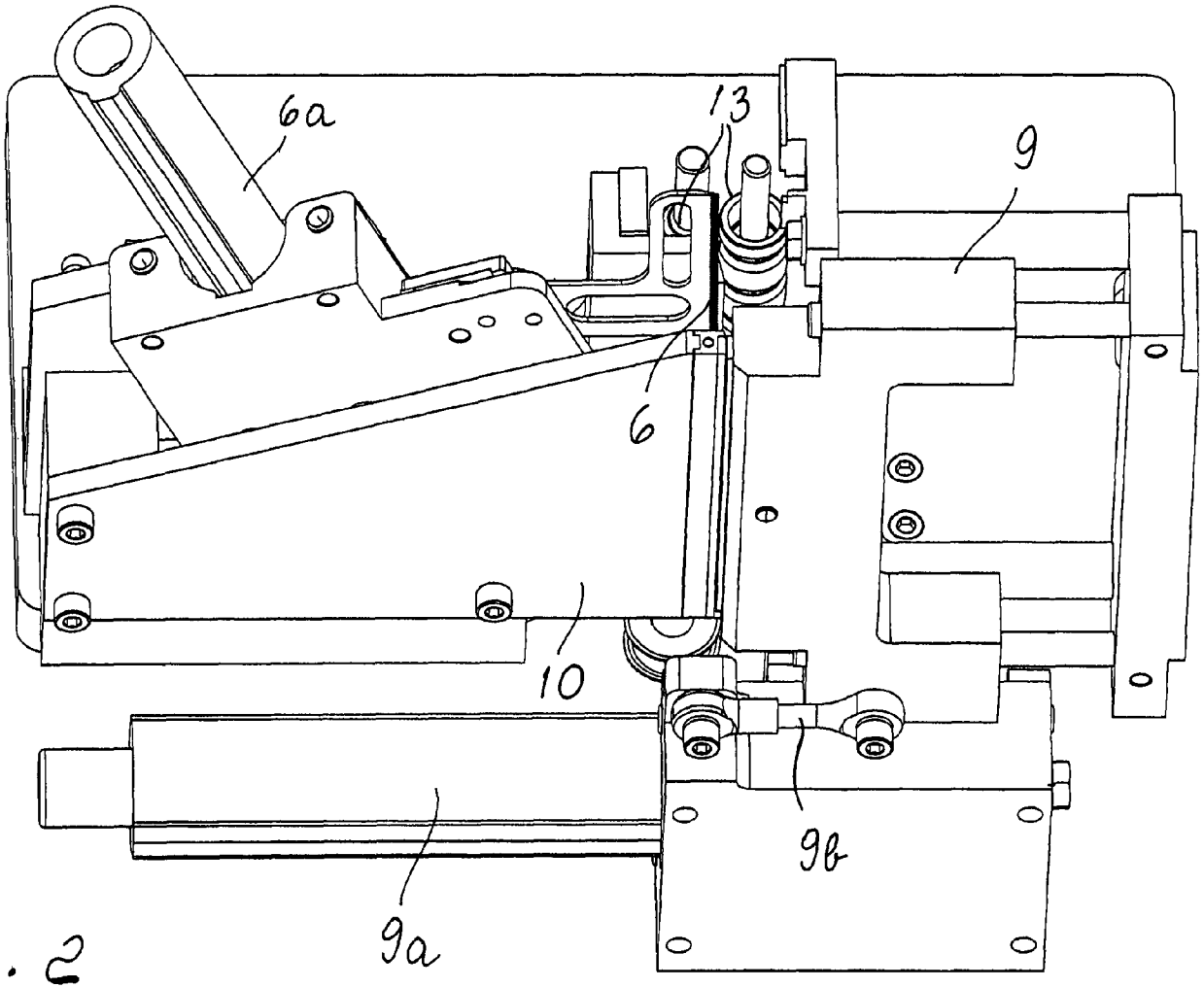
FIG. 2 is a perspective view of a detail of the machine of FIG. 1.

With reference to the figures, the reference numeral 1 generally designates a labeling machine, which comprises in a known manner a carousel 2 for conveying containers 3 to be labeled, which are loaded by means of an input star conveyor 4 and unloaded by means of an output star conveyor 5.

A main feature of the invention consists in the presence of an intermittent cutting device, which comprises a blade 6 actuated by an actuation cylinder 6*a*, which cuts each individual label, taking it from a ribbon 7 which is conveyed thereto with the appropriate timing, by unwinding it from a reel 8 by way of feeder means which will be described hereinafter, and further in the presence of means for locking the label during cutting, which comprise a slider 9, which can move, by way of the action of an actuation cylinder 9*a* and by means of a linkage 9*b*, between a position for compression of the label in contact with the abutment surface located at the end of a fixed block 10, and a position for spacing from the label. The locking means are located between the intermittent cutting device and a transfer drum 11, which, by working in a known manner, carries the label to a container 3.

The means for feeding the ribbon 7 with the appropriate timing to the intermittent cutting device comprise a motorized device for unwinding the reel 8, which is schematically illustrated and designated by the reference numeral 12, and a pair of transfer rollers 13 arranged in the immediate vicinity of the cutting device; the reference numeral 14 designates a photocell which, when it detects the passage of each individual label, sends a stop command to the described feeder means.

The machine is further provided with means which are adapted to control the actuation of the device for cutting and locking a label in step with the container designed to receive the label.

Operation of the invention is as follows.

When a label 15 arrives at the cutting and locking device, the photocell 14 detects the passage of a reference provided on the label and actuates the halting of the feeder means: in this manner, the label stops and slides on the transfer drum 11, which rotates at all times.

When the container 3 designed to receive the label 15 arrives, conveyed by the carousel 2, in the position in step for perfect execution of the operation, the appropriate means provided on the machine actuate the means for locking the label 15 and the device for cutting it, reopening the locking means, which free the cut label, allowing it to reach, conveyed by the drum 11, the intended container.

In the meantime, the ribbon feeding means have restarted and a new cycle is performed immediately.

The labeling machine of the invention is susceptible of numerous modifications and variations, all of which are within the scope of the appended claims: thus, for example, the intermittent cutting device, which in the described embodiment is of the type disclosed in WO2007/134745 by the same applicant, may be of any type.

The carousel for conveying the containers 3 can be replaced by a linear conveyor, and moreover an assembly can be provided for pasting the labels if they are not of the pre-pasted type, as in the case of the labels discussed here.

The means for locking the label during cutting may comprise a device for aspirating the label against an abutment surface, particularly in the case of pre-pasted labels.

The disclosures in Italian Patent Application No. MN2007A000010 from which this application claims priority are incorporated herein by reference.

Where technical features mentioned in any claim are followed by reference signs, those reference signs have been included for the sole purpose of increasing the intelligibility of the claims and accordingly, such reference signs do not have any limiting effect on the interpretation of each element identified by way of example by such reference signs.

What is claimed is:

1. A labeling machine, comprising a conveyor of containers, each to be labeled with a label taken by cutting from continuous ribbon wound in a reel, an intermittent cutting device for intermittent cutting of each individual label, a feeder which is adapted to convey with the appropriate timing the ribbon in a feeding direction to said intermittent cutting device, said feeder comprising a device for unwinding the ribbon from a reel and a pair of rollers for moving the ribbon which are arranged in the immediate vicinity of said cutting device, a drum for transferring the cut label to a container provided on the conveyor, and a label locking mechanism for locking the label during cutting, said label locking mechanism being arranged downstream of said cutting device with respect to said feeding direction of the ribbon and said label locking mechanism being arranged between said cutting device and said drum for transferring the cut label with respect to said feeding direction of the ribbon, said label locking mechanism comprising a slider and a fixed block provided with an fixed abutment surface, said slider and said fixed block being arranged at opposite sides of said ribbon, said slider being configured to move between a cutting position for compressing said label in contact with said abutment surface whereby the label is cut when said slider compresses said label in contact with said abutment surface in said cutting position and a position for separation from said label, said ribbon moving between said pair of rollers which are arranged adjacent said cutting device, said cutting device being arranged between said pair of rollers and said label locking mechanism with respect to said feeding direction of the ribbon;

wherein said pair of rollers are configured to exert a compression force on the ribbon such that a tension is maintained in the ribbon between the pair of rollers and the label locking mechanism when the label locking mechanism is in the cutting position.

2. The labeling machine according to claim 1, further comprising a photocell which, when the passage of each individual label is detected, sends a command to stop said feeder.

3. A labeling machine, comprising a conveyor of containers each to be labeled with a label taken by cutting from a continuous ribbon wound in a reel, an intermittent cutting device for intermittent cutting of each individual label, a feeder which is adapted to convey with the appropriate timing the ribbon in a feeding direction to said intermittent cutting device said feeder comprising a device for unwinding the ribbon from a reel and a pair of rollers for moving the ribbon which are arranged in the immediate vicinity of said cutting device, a drum for transferring the cut label to a container provided on the conveyor, and a label locking mechanism for locking the label during cutting said label locking mechanism being arranged downstream of said cutting device with respect to said feeding direction of the ribbon and said label locking mechanism being arranged between laid cutting device and said drum for transferring the cut label with respect to said feeding direction of the ribbon, said label locking mechanism comprising a slider and a fixed block provided with a fixed abutment surface said slider and said fixed block being arranged at opposite sides of said ribbon said slider being configured to move between a cutting position for compressing said label in contact with said abutment surface whereby the label is cut when said slider compresses said label in contact with said abutment surface in said cutting position and a position for separation from said label, said ribbon moving between said pair of rollers which are arranged adjacent said cutting device, said cutting device being arranged between said pair of rollers and said label locking mechanism with respect to said feeding direction of the ribbon, the labeling machine further comprising a controller adapted to control the actuation of the cutting device and of the slider for locking a label waiting to be cut in step with the container intended to receive said label;

wherein said pair of rollers are configured to exert a compression force on the ribbon such that a tension is maintained in the ribbon between the pair of rollers and the label locking mechanism when the label locking mechanism is in the cutting position.

* * * * *